United States Patent [19]

Bryant

[11] 4,124,244

[45] Nov. 7, 1978

[54] PROTECTIVE PADS FOR OVERHEAD LIFTING

[76] Inventor: John G. Bryant, 15 Ridgewood Rd., Radnor, Pa. 19087

[21] Appl. No.: 752,723

[22] Filed: Dec. 21, 1976

[51] Int. Cl.[2] ..... B66C 1/12

[52] U.S. Cl. ..... 294/74

[58] Field of Search ..... 294/74–77; 138/130, 144; 156/171, 188; 190/37; 217/69; 206/453, 586, 597; 224/49; 428/377

[56] References Cited

U.S. PATENT DOCUMENTS

| | | | |
|---|---|---|---|
| 532,902 | 1/1895 | Palmer | 138/130 X |
| 1,465,801 | 8/1923 | Bell | 294/74 UX |
| 2,093,411 | 9/1937 | Bowden et al. | 428/377 X |
| 2,567,872 | 9/1951 | Burke | 294/74 X |
| 3,317,233 | 5/1967 | Black | 294/74 |
| 3,335,932 | 8/1967 | Brown | 206/453 X |
| 3,420,722 | 1/1969 | McNulty et al. | 156/188 X |
| 3,433,354 | 3/1969 | Liebel | 206/586 |
| 3,899,206 | 8/1975 | Miura | 294/74 |
| 4,039,217 | 8/1977 | Bryant | 294/74 |
| 4,039,218 | 8/1977 | Bryant | 294/74 |

*Primary Examiner*—Johnny D. Cherry
*Attorney, Agent, or Firm*—Frederick J. Olsson

[57] ABSTRACT

A pad to be disposed between a load and a sling. The pad has at least two woven Nylon bands or layers joined together by a yieldable, flexible adhesive. The warp threads of the bands are respectively angularly oriented.

21 Claims, 17 Drawing Figures

PROTECTIVE PADS FOR OVERHEAD LIFTING

This invention relates to overhead materials handling equipment and in particular relates to a pad to be disposed between a lifting sling and a load.

One object of the invention is to provide a pad for use in connection with fabric, chain and cable slings, the pad being made of woven material arranged in multi-layers wherein threads of the adjacent layers are angularly disposed so as to optimize maintainance of thread position and/or the packing of threads (in the thickness direction) when the pad is in the lift condition and thereby increase the compression capacity to pad size ratio.

Another object of the invention is to provide a pad for use in connection with chain type slings, the pad being made of woven material arranged in multi-layers wherein threads of the adjacent layers are angularly disposed so as to optimize resistance to spreading caused by the spot stress concentration of the chain links when the pad is in the lift condition whereby to avoid pad rupture and thereby increase the compression capacity to pad size ratio. Another object of the invention is to provide a pad for use in connection with cable type slings, the pad being made of woven material arranged in multi-layers wherein threads of adjacent layers are angularly disposed so as to optimize resistance to spreading caused by the line stress concentration of the cable when the pad is in the lift condition whereby to avoid pad rupture and thereby increase the compression capacity to pad size ratio.

Another object of the invention is to provide pads of the kind in question in either sleeve or planar form having a clutch action, i.e. permitting relative shifting as between the load and the sling to occur while maintaining the same out of contact and thereby avoid sharp corners on a load cutting the sling or the sling scraping or otherwise marring the load.

There are several preferred forms of the invention and these will be explained below in connection with the drawings attached all of which are diagramatic.

The pads of the invention are manufactured using conventional bands of woven Nylon webbing as the base structural material. This is highly advantageous from the standpoint of savings over custom made material. Thus, the pads of the invention will be described in connection with such standard webbing or bands. It will be apparent, however, as the description proceeds that the various layers and plys referred to can be made by using custom made material. With respect to the term "compression capacity", it will be understood that this refers to the ability of the pad to resist compressive loads.

Figure 1:
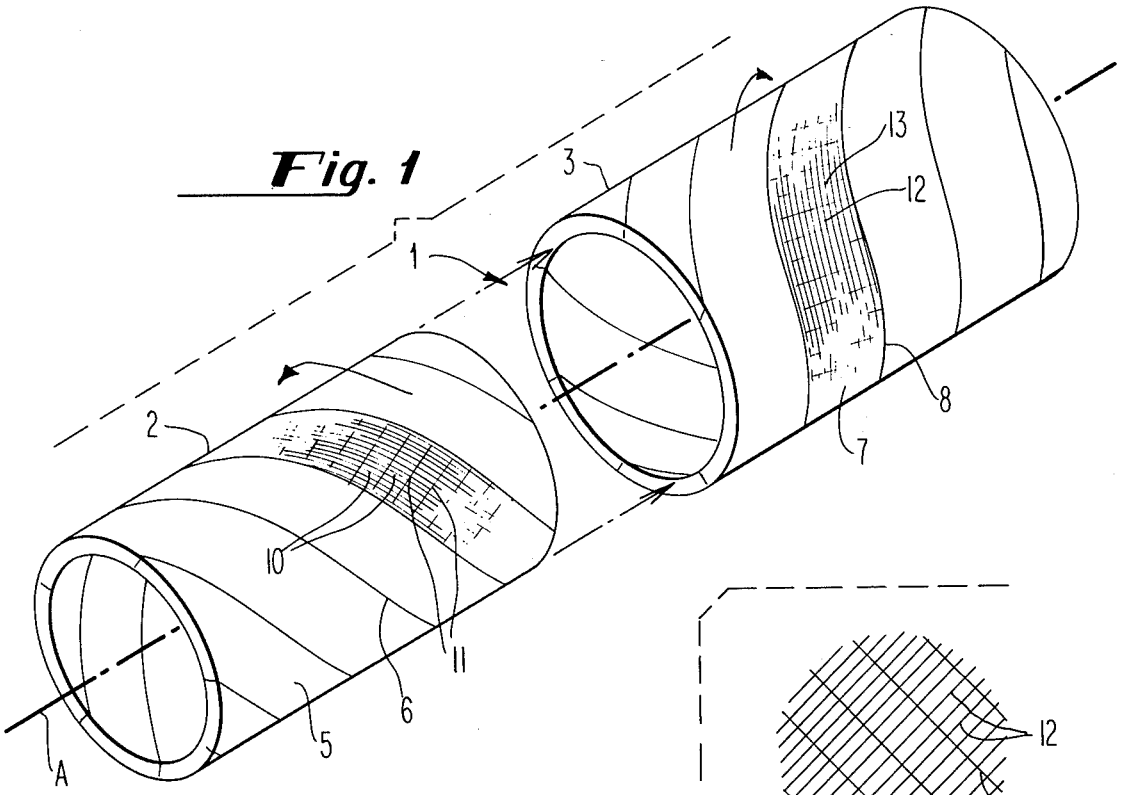
FIG. 1 is a perspective exploded view of a pad of the invention arranged in sleeve form.
Figure 2:
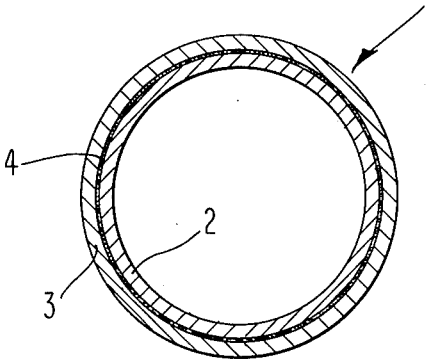
FIG. 2 is a cross sectional view of the pad of FIG. 1.

In FIGS. 1 and 2 the sleeve type pad 1 has the inner layer 2 and the outer layer 3. While I have shown the layers axially spaced apart it will be understood that the layer 2 is disposed within the layer 3 as indicated in FIG. 2. The layers are co-axial with the axis A. A yieldable, flexible adhesive 4 (FIG. 2) is disposed between the layers and connects the same together. For the sake of clarity I have not shown the adhesive in FIG. 1. The inside layer 2 is adapted to receive and engage a sling and the outside layer 3 is adapted to engage the load.

The inner layer 2 is formed from a band of woven Nylon or webbing 5 which is wound in a helix about the axis A. The direction of the helix is indicated at 6 which represents the abutting edges of the band. The outer layer 3 is also formed from a band of woven Nylon or webbing 7 wound into a helix, the direction of which is indicated at 8 (representing the abutting edges). It will be observed that the direction of the helix of band 2 is opposite or reverse the direction of the helix of band 3.

The preferred technique for constructing the pad is explained following. For the inner layer 2, one end of the band is taped to a mandrel and then wound around the mandrel in helical form over an axial distance consistant with the desired length of the pad. The free end is taped to the mandrel. Then an adhesive is brushed or otherwise applied to the outer surface of the band. Next, one end of another band is taped to the mandrel and wound in the opposite direction over the adhesive. The free end is then taped to the mandrel. After an appropriate curing time, a hot knife is used to cut thru the layers to form the opposite ends of the pad. This operation melts the material and fuses the ends together. The formed pad is then slipped off the mandrel.

The conventional structure of woven Nylon bands includes a set of warp threads running parallel to the longitudinal axis of the band and a set of woof threads running transverse generally at 90°. The sets interlock and function to hold one another in position. Usually, there are more warp threads than woof threads. This is done to provide the greater strength in the axial direction. In the band 5 the warp threads are diagramatically indicated at 10 and the woof threads at 11. In the band 7 the warp and woof threads are diagramatically indicated at 12 and 13.

Figure 3:
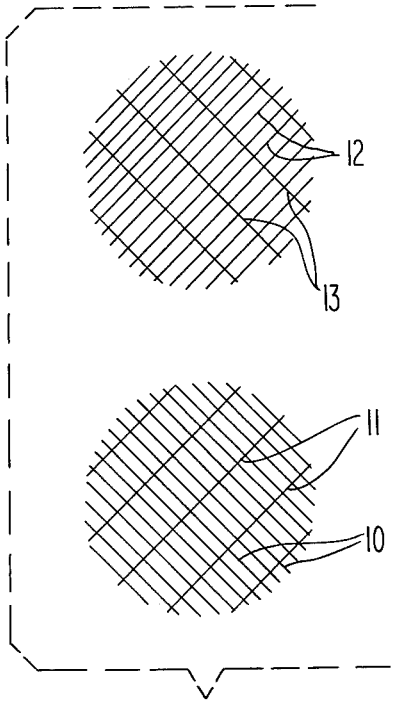
FIG. 3 is a perspective exploded view illustrating the angular relationship of the threads in the pad of FIG. 1.

By winding the bands in reverse helical form, the sets of warp threads (and sets of woof threads) are angularly oriented with respect to one another. This is diagramatically illustrated in FIG. 3 where it will be seen that contiguous parallel planes thru the set of warp threads 10 will intersect the set of warp threads 13. The same is true of the respective sets of woof threads. Expressed in another way it will be apparent that the warp and woof threads 10 and 11 each extend at an angle to a plane (say a vertical plane) containing the axis A. The same condition pertains for the threads 12 and 13 but at different angles.

The angular orientation of the respective sets of threads is highly advantageous from the standpoint of improving the compression capacity to pad size ratio of the pads. I believe this is attained by that the angular orientation is conducive to the various threads (when the pad is under the lift condition) being maintained in position and better packed in the thickness direction of the pad so as to attain a more uniform density. Thus, there is more of the pad, so to speak, to perform its intended function.

The angular orientation of the respective sets of threads improves the anti-rupture characteristics of the pad particularly when the same is used with chains and cable type slings. With chain type slings the angular orientation of the sets of threads in the respective layers resists the spreading effect generated by high stress concentration of individual links. This stops the links pushing the fibers apart and bursting thru the pad and causing the same to rupture. The same effect is obtained when the pad is used with cable type slings where the cable makes a high stress concentration along a line of contact.

Figure 4:
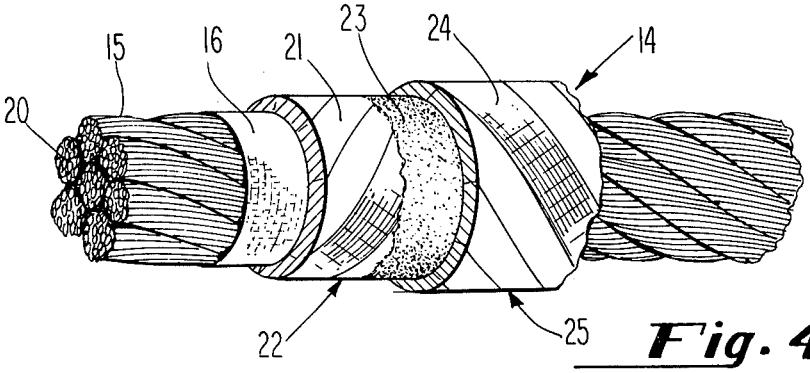
FIG. 4 is a fragmentary perspective view of a pad of the kind as shown in FIG. 1 permanently attached to a cable or wire rope sling.

In FIG. 4, I have illustrated a highly useful application of the type of pad shown in FIG. 1. In this application the pad 14 is permanently secured to a cable or wire rope sling 15.

In constructing the embodiment of FIG. 4, a fixture is provided so that the cable can be stretched in generally a horizontal position. Then a woven Nylon material 16 is wrapped around or slipped over the cable. Using the method explained in connection with the pad of FIG. 1, a woven Nylon band 21 is wound in a helix on the cable to form the inner layer 22. Then adhesive 23 is applied to the outer surface of the layer 22. The woven Nylon band in 24 then is wound in a reverse helix pattern over the adhesive to form outer layer 25. After an appropriate time curing, a hot knife is used to cut thru the assembly to form the ends of the pad. The excess is stripped from the cable.

The material 16 is not essential but I prefer to use the same as it tends to act as a cushion for inner layer 22 and fill the voids between strands 20.

The direction of helix of the band 21 is different from the direction of the helix of the band 24. The sets of warp and woof threads of the bands forming the inner and outer layers 22 and 25 are oriented as explained in connection with the pad of FIG. 1.

Figure 5:
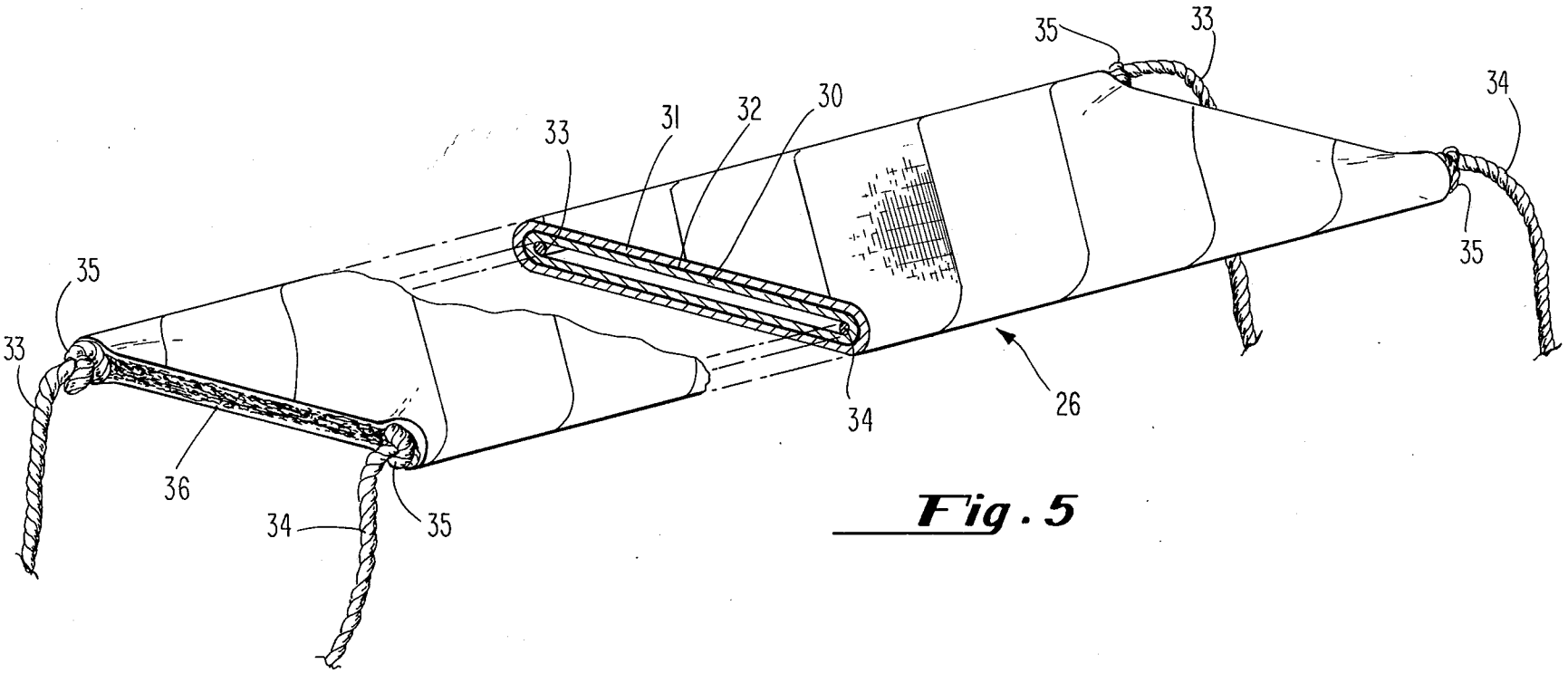
FIG. 5 is a perspective view of a pad (partially broken away) having the construction of the pad of FIG. 1 but arranged in generally planar form.
Figure 6:
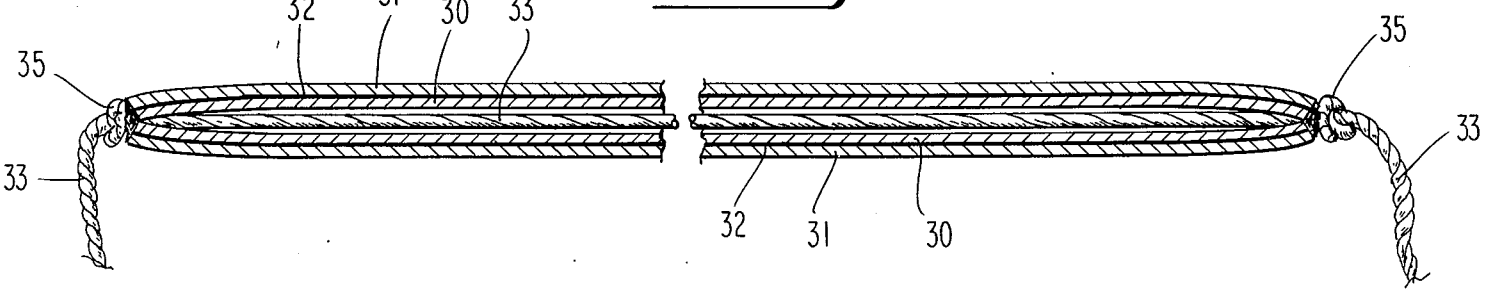
FIG. 6 is a cross sectional view of the pad of FIG. 5.

In FIGS. 5 and 6, I have illustrated a pad of the invention arranged in generally planar form. The pad 26 is made by first forming a sleeve type pad of the kind shown in FIG. 1. The pad 26 includes the inner layer 30, the outer layer 31 and adhesive 32 between the layers and joining the same together. The layers 30 and 31 are comprised of woven Nylon bands which are respectively wound into reverse helical forms as previously described.

After forming the sleeve, the same is then put into a press and pushed so that it assumes the annular but generally oval shape as shown. Prior to the pad being pressed into the oval shape, a pair of ropes 33 and 34 are positioned in the sleeve so that when the pad assumes the oval shape the ropes are on the opposite sides as shown. These ropes are made from Nylon or cotton and are knotted at each end as indicated at 35. The knots act as means to retain the ropes in position. The free ends of the ropes 33 and 34 are used to tie the pad to the sling.

After the pad has been pressed into the oval shape and with the ropes positioned as mentioned above, a hot knife is applied to each end so as to fuse the inner and outer layers 30 and 31 together as indicated for the left hand end 36 in FIG. 6. By fusing the ends as described the pad will retain its generally planar or oval shape. In lieu of joining ends by fusing, appropriate stitching can be applied across the respective ends.

It will be understood that with the pad in planar form, the condition of angularly oriented sets of warp and woof threads as between the inner and outer layers as explained in connection with FIG. 1 is attained.

Either one of the generally planar sides of the pad 26 can be employed against either the load or the sling. Desirably the sides are used alternatively so as to obtain uniform wear characteristics.

Figure 7:
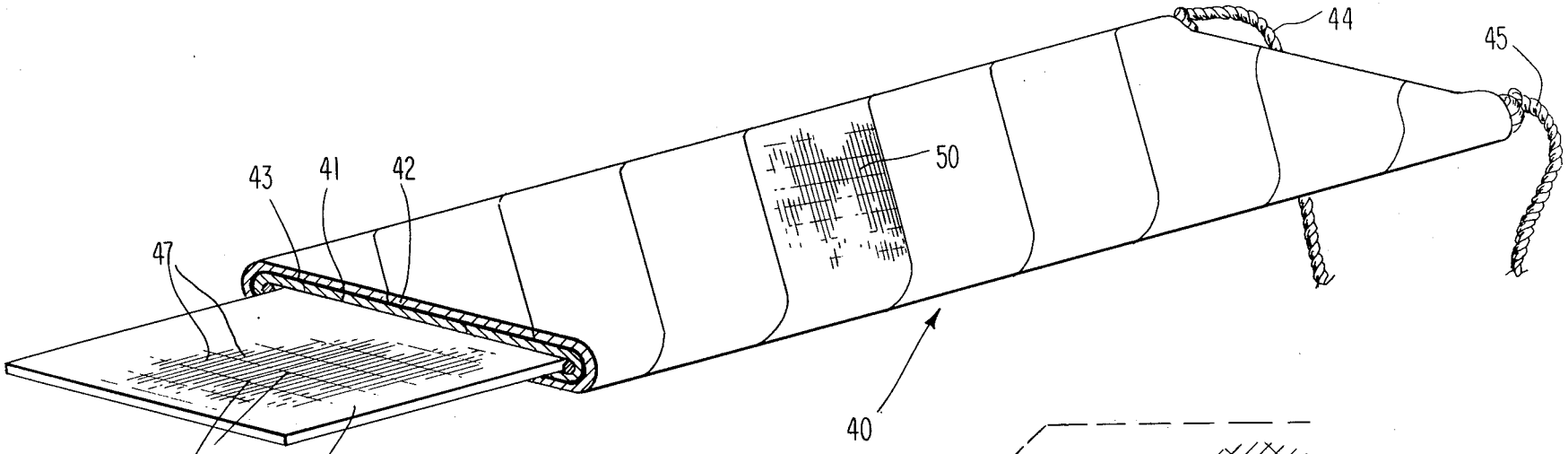
FIG. 7 is a perspective view of a pad (partially broken away) having the construction of the pad of FIG. 5 and including an additional member to obtain compression load resistance.

In FIG. 7 I have illustrated a planar type pad similar to the pad 26 of FIG. 5 but arranged for much higher load capacity. In FIG. 7, the left hand end of the pad 40 is broken away. This has been done for descriptive purposes. It will be understood that the end is fused the same as the ends of the pad 26 of FIG. 5.

The pad has inner layer 41 and outer layer 42 joined by the adhesive 43. The layers are comprised of woven Nylon bands arranged in helical form. The ropes 44 and 45 run thru the pad and extend outwardly to serve as means for fastening the pad to the sling.

The pad 40 differs from the pad 26 by that a third layer 46 made of a band of woven Nylon or webbing is disposed inside the inner layer 41 and extends length wise end-to-end of the pad. The layer 46 increases the compression capacity to pad size ratio.

Figure 8:
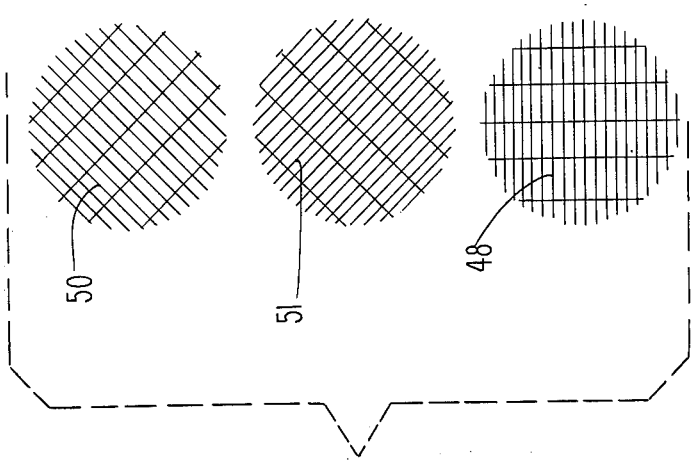
FIG. 8 is a perspective exploded view illustrating the angular arrangement of the threads in the pad of FIG. 7.

The warp threads 47 of the layer 46 extend length wise and the woof threads 48 extend transverse the longitudinal axis of the pad. The angualar orientation of the warp threads is diagrammatically illustrated in FIG. 8, which is a representation of the top side of the pad.

The warp threads 50 of the outer layer 42 and the warp threads 51 of the inner layer 41 are oriented at an angle with respect to one another. The warp threads 47 of the third layer 46 are oriented at an angle to the warp threads 50 and 51. It will be evident that contiguous planes thru the threads 47 will angularly intersect the threads 51 and 50.

The invention contemplates incorporating the angularly oriented thread concept in a pad structure that provides for clutch action, i.e. the pad provides for relative motion as between the load and the sling to occur while maintaining the same out of contact and thereby avoid a sharp corner on a load cutting the sling or the sling scraping or other wise marring the load. The clutch action concept is disclosed in my co-pending application Ser. No. 204,932 filed Dec. 6, 1971 and entitled CLUTCH PADS now U.S. Pat. No. 4,039,217. Such pads are both in sleeve and planar form. Some typical pads are discussed below.

Figure 9:
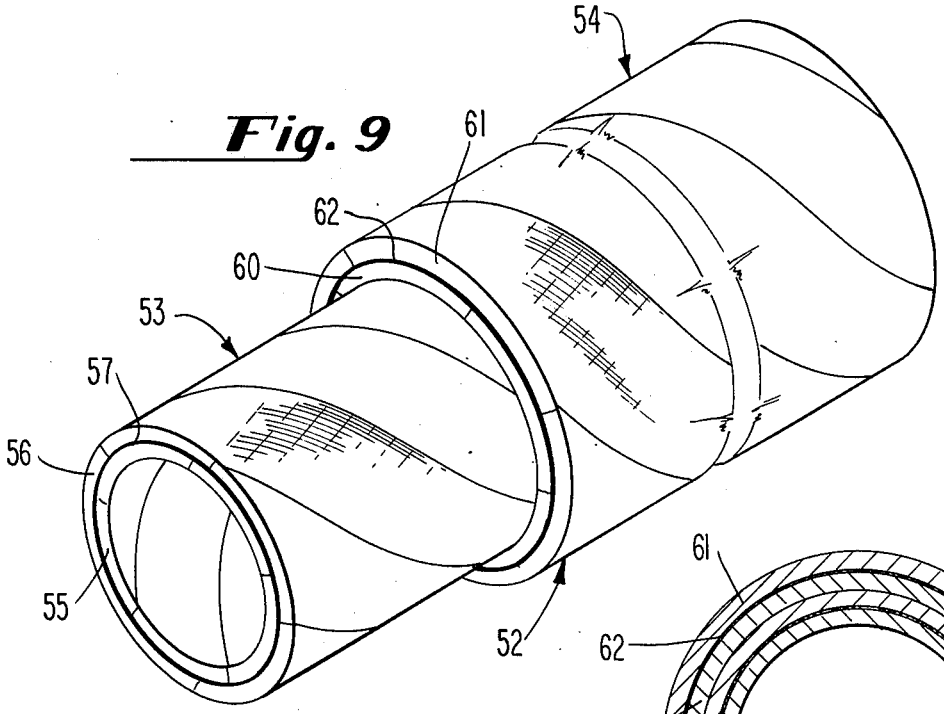
FIG. 9 is a perspective exploded view of a sleeve type pad of the invention arranged for clutch action.
Figure 10:
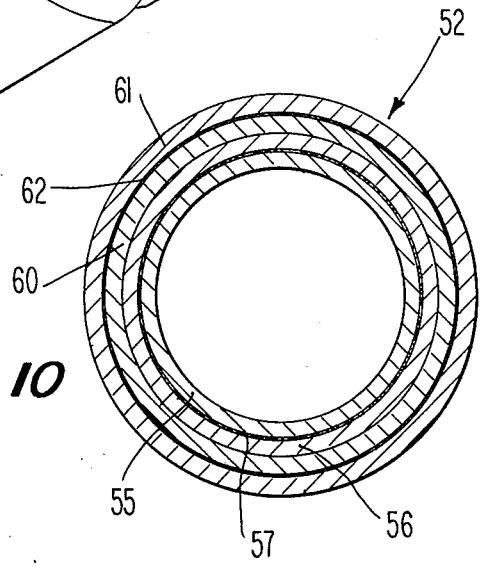
FIG. 10 is a cross sectional view of the pad of FIG. 9.
Figure 11:
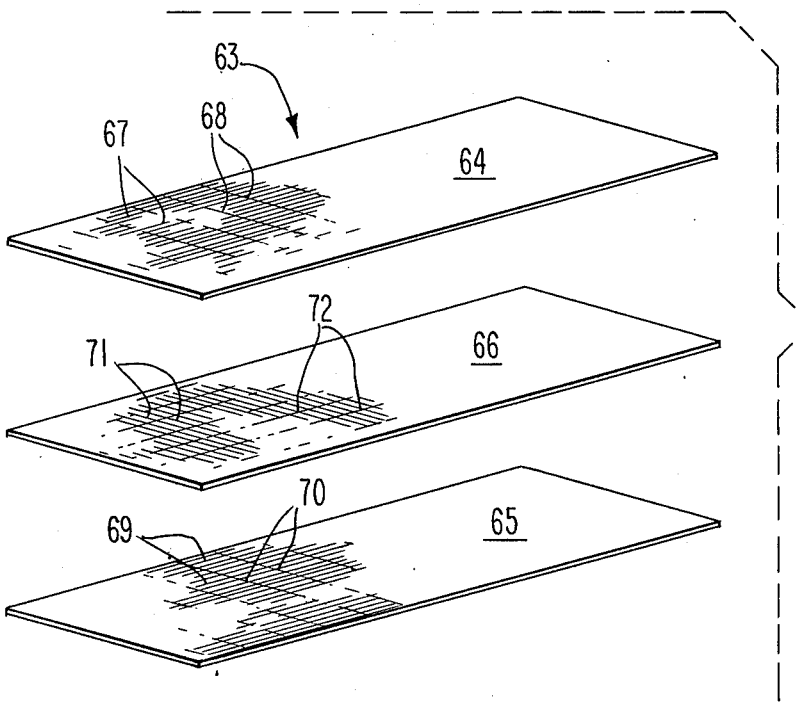
FIG. 11 is a perspective exploded view of the plys or layers of a pad of the invention arranged for clutch action in planar form.

In FIGS. 9 and 10 I have shown a sleeve type clutch pad 52 which has an inner ply 53 and an outer ply 54 each of which is constructed the same as the sleeve pad 1 of FIG. 1.

The inner ply 53 includes the inner layer 55 and outer layer 56 formed of woven Nylon bands wound in reverse helixes and connected by adhesive 57. The outer ply 54 includes the inner layer 60 and outer layer 61 also formed of woven Nylon bands wound in reverse helixes and joined by the adhesive 62.

The inner ply 53 is adapted to receive and engage with a sling and the outer ply 54 is adapted to contact the load.

To provide the slide permitting means in the pad of FIG. 9 the outer layer 56 and the inner layer 60 may be uncoated so that the engaging virgin Nylon threads or filaments provide a low friction surface to attain the clutch action. Alternatively the layer 56 and 60 can be coated with a material such as silicon.

In as much as the plys 53 and 54 are constructed with layers as the pad of FIG. 1, the warp and woof threads of the respective layer are angularly oriented as previously described.

One advantageous application of a pad of the kind described in connection with FIGS. 9 and 10 is to permanently secure the same to a cable or wire rope sling. For such purposes, the techniques explained in connection with FIG. 4 are employed.

In FIGS. 11–14 I have illustrated a planar type pad employing the angularly oriented thread concept and constructed to provide clutch action.

The pad 63 comprises a ply 64, a ply 65 and the intermediate ply 66 between the plys 64 and 65. For descriptive purposes I have shown in FIG. 11 plys 64, 65 and 66 as being spaced apart. It will be understood that adjacent plys contact one another as indicated in FIG. 12.

In the ply 64, the warp threads 67 run parallel to the longitudinal axis of the ply and woof threads 68 run transverse. In the ply 65 the warp threads 69 and woof threads 70 run in the same direction as the corresponding threads in ply 64. In the intermediate ply 66 the warp threads 71 run transverse to the longitudinal axis of the ply and the woof threads 72 run parallel. This construction provides that contiguous parallel planes thru the warp threads 67 or 69 angularly intersect the warp threads 71 of the intermediate ply 66. The slide permitting means is provided in pad 63 by that the Nylon threads are uncoated or are provided with a coating of silicon or similar low friction causing material.

The outer plys 64 and 65 are axial sections cut from a band of Nylon webbing. The inner ply 64 is formed by cutting a transverse strip from a wide band of Nylon webbing. The cut is made with a hot knife so that edges are sealed. Normally the maximum width of the standard web is approximately 24 inches. If a longer pad is required several sections are set out side-by-side and abutting edges fused by melting or covered by a thin piece of webbing held down on opposite sides of the joint by adhesive or sewing.

Figure 13:
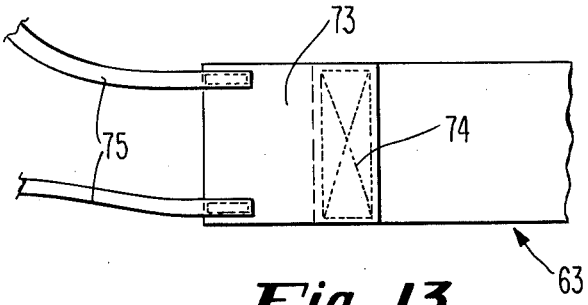
FIG. 13 is a plan view of the pad of FIG. 12.
Figure 12:
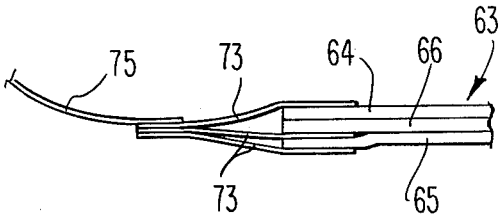
FIG. 12 is a fragmentary elevational side view of the pad of FIG. 11 illustrating one method of connecting the ends of the pad.
Figure 14:
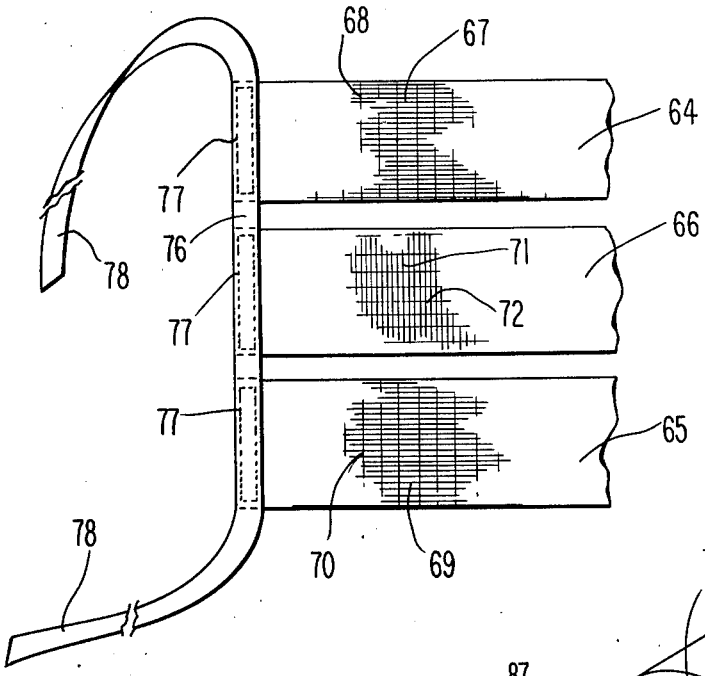
FIG. 14 is a plan view illustrating an alternative method for connecting the ends of the pad of FIG. 11.

The opposite ends of the plys 64, 65 and 66 are joined together and typical means for doing this are shown in FIGS. 12–14. In FIGS. 12 and 13 the fabric end pieces 73 are stitched to the plys as indicated at 74. The straps 75 provide a means for securing the pad to a sling. The fabric end pieces 73 permit the plys to shift relative to one another.

In FIG. 14 the fabric webbing 76 is stitched to the plys as indicated at 77. The extensions 78 form the means to tie the pad to the sling. With the construction of FIG. 14 the plys can be folded in various combinations so that any one of the plys forms the intermediate ply and the other form the inner and outer plys. This is advantageous from the standpoint of providing uniform wear on the plys.

Figure 15:
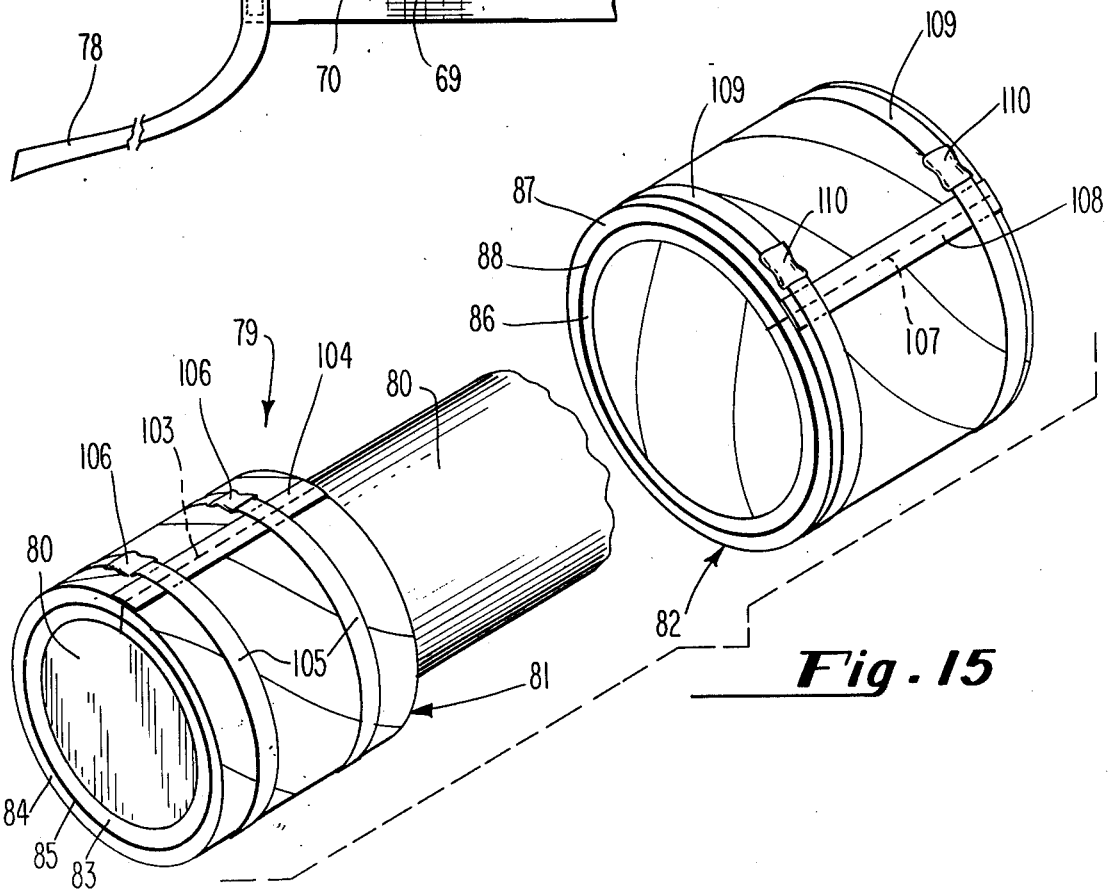
FIG. 15 is an exploded perspective view of a pad of the invention arranged for clutch action and particularly for use in an application for lifting very large loads wherein the pad is attached to the load.
Figure 16:
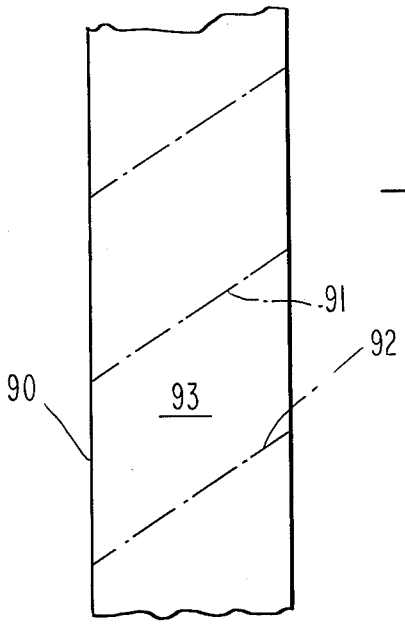
FIG. 16 is a diagramatic plan view of a woven Nylon band illustrating the forming of parts for the layers of the pad of FIG. 15.
Figure 17:
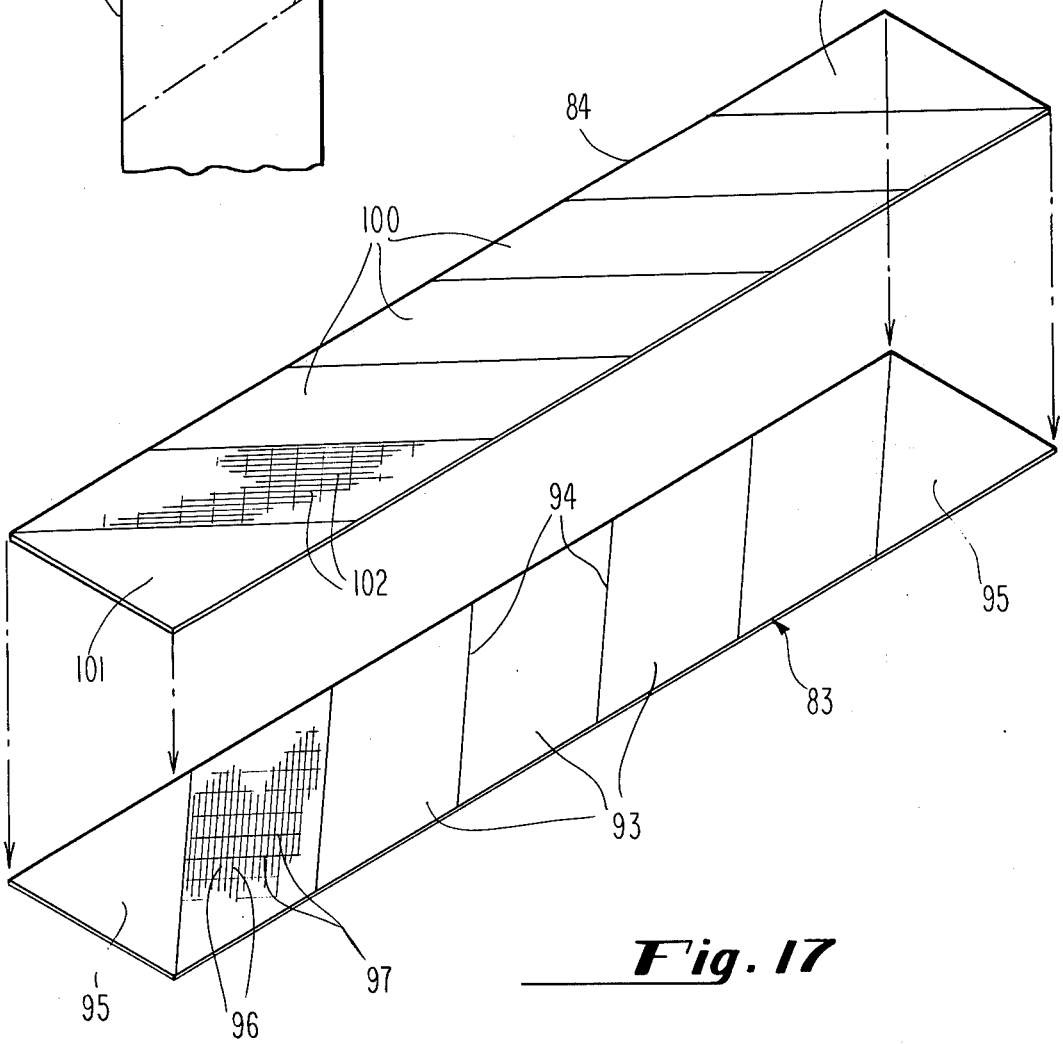
FIG. 17 is a diagramatic exploded view illustrating the assembly of a layer of ply of FIG. 15.

In FIGS. 15–17 I have illustrated a sleeve type clutch pad 79 in which the inner layer engages the load and the outer layer is engaged by the lifting sling. The embodiment shown in for use in lifting very large loads.

In FIG. 15 a bearing shaft is indicated at 80. The shaft is connected to a rotor not shown and an identical bearing shaft extends from the opposite side of the rotor. The shafts are highly polished and for shipment purposes are covered with a rust preventative coating such as Cosmolene and most times with a plastic wrap. For purposes of clarity, the latter parts are not shown. In transporting such a roller from the manufacturing site to the installation site it is important that the overhead lifting mechanism does not cut or open the protective coatings. This presents a substantial problem because rotors of the kind in question may weigh in the order of 100 tons. A clutch pad such as illustrated in FIG. 15 achieves the objective of maintaining the protective coating intact.

The pad includes the inner ply 81 and the outer ply 82. For descriptive purposes, the pads are shown as separated but it will be understood that ply 81 is inside the ply 82.

The inner ply 81 comprises the inner layer 83 and outer layer 84 joined by adhesive 85. The outer ply 82 comprises the inner layer 86 and the outer layer 87 joined by the adhesive 88.

The layers 83, 84, 86 and 87 are constructed somewhat differently from the layers of the sleeve type clutch pad 52 of FIG. 9. The reason for the difference in construction is due to very large dimensions of the pad 79. A technique for layer construction which attains the desired angular orientation of the threads is diagramatically illustrated in FIGS. 16 and 17 for the ply 81.

In FIG. 16, a band 90 (with its warp threads running along the longitudinal axis) is severed at 91 and 92 to form a section 93. It will be observed that the band is severed at an angle to the longitudinal axis or the direction of the warp threads. A hot knife is employed so that the edges at 91 and 92 are fused. The above process is repeated until the required number of sections 93 are formed. The sections 93 are then placed side-by-side as indicated in FIG. 17. The adjacent edges abut each other at 94. The end sections 95 are cut from the band 90 and positioned as shown in FIG. 17. For assembly purposes, the sections 93 and 95 can be held in position by a few melts along the abutting edges.

The foregoing procedure forms the generally rectangular shaped layer 83 wherein the warp threads 96 (and the woof threads 97) of each section extend at an angle to the longitudinal axis of the layer.

The sections 100 and the sections 101 of the layer 84 are cut similarly as the sections 93 and 95. The adhesive 85 is then applied to the surface of the layer 83 and the sections 100 and 101 positioned down on the adhesive.

As indicated in FIG. 17, sections 100 and 101 of layer 84 are cut and positioned so that the warp threads 102 are angularly oriented with respect to the warp threads 96 of layer 83.

The ply 82 is similarly constructed. The plys are then assembled to the roller shaft 80.

The inner ply 81 is wrapped around the shaft 80. The length of the ply is chosen so that the ends abut one another or are closely spaced in the area indicated at line 103. Thus the layer is discontinuous rather than being continuous as the layers in the pad 52 of FIG. 9. A rectangular shaped cover 104 is then placed over the end area. The cover 104 is preferably formed from the band 90 so that the cover comprises the same material as the layers.

The ply 81 is retained in its annular shape on the roller shaft 80 and the cover 104 maintained in position by the straps 105. These preferably are Signode steel or plastic straping. The straps are held by fasteners 106. It will be observed that the ends of ply 81, cover 104 and strap fasteners 106 are positioned in the top area over the shaft 80.

The ply 82 is then placed over the ply 81 with the edges abutting or closely spaced at 107 and covered by a cover 108 and held in position by the straps 109. The straps are held by fasteners 110. The cover 108 is offset from the cover 104, the straps 109 are offset from the straps 105 and the fasteners 110 are offset from fasteners 106.

In the pad of FIG. 15 the slide permitting means is provided by that the contacting layers 84 and 86 each have a coating of low friction material.

It will be observed that the covers 104 and 108 and the fasteners 106 and 110 are above the mid-section of the assembly and therefore are not subjected to direct pressure from the slings.

An important advantage of the arrangement of FIG. 15 is that the pad protects the bearing surfaces from physical damage that might other wise be inflicted by objects contacting the surface while the rotor is in storage and or being transported, for example, some object falling on the shaft or some piece of equipment being pushed into the shaft.

While the embodiment of FIG. 15 is arranged for clutch action, it will be understood that the invention contemplates a non-clutch action pad such as, for example, the pad shown in FIGS. 1 and 2. This type of pad protects the bearing surfaces from damage by objects and equipment as mentioned.

I claim:

1. In a pad for use between a load and an overhead lifting sling wherein the pad receives a compression load during the lift:

a plurality of layers disposed closely adjacent one another at least one layer to engage the sling and at least another layer to engage the load and each layer comprising band means having a woven construction with warp and woof threads which interlock and function to hold one another in the layer to take said compression load and the respective band means being oriented so that as between adjacent band means contiguous parallel planes containing warp threads of one band means respectively angularly intersect warp threads of the other band means.

2. The pad of claim 1 characterized by:

first and second annular shaped layers, the layers being co-axial about an axis and one layer being inside the other, the inside layer to receive and engage the sling and the outside layer to engage the load;

yieldable, flexible adhesive means between the layers and connecting the layers together;

said first layer comprising a first woven band wound into a helix about said axis whereby the warp and woof threads of the band each respectively extend at an angle to a plane containing said axis; and said second layer comprising a second woven band wound into a helix about said axis whereby the warp and woof threads of the second band each respectively extend at an angle to said plane, the direction of the helix of the second band being opposite the direction of the helix of the first band.

3. In combination;

The pad of claim 1 further including a wire rope sling and characterized by:

first and second annular shaped layers, the layers being co-axial about an axis and the second layer being inside the first, and the second layer being tightly engaged with the periphery of the sling;

yieldable, flexible adhesive means between the layers and connecting the layers together;

said first layer comprising a first woven band wound into a helix about said axis whereby the warp and woof threads of the band each respectively extend at an angle to a plane containing said axis; and said second layer comprising a second woven band wound into a helix about said axis whereby the warp and woof threads of the second band each respectively extend at an angle to said plane, the direction of the helix of the second band being opposite the direction of the helix of the first band.

4. The combination of claim 3 further including a band of cushioning/filler material between the sling and said second layer.

5. In a pad for use between a load and an overhead lifting sling:

first and second annular layers, the second layer being disposed inside the first layer and each formed in the shape of an oval and being co-axial about an axis, the long sides of the oval of the outer layer being adapted to engage the load or the sling;

yieldable, flexible adhesive between the layers and connecting the layers together;

said first layer comprising a first woven band having warp and woof threads and wound into a helix about said axis whereby the warp and woof threads of the band each respectively extend at an angle to a plane containing said axis;

said second layer comprising a second woven band having warp and woof threads and wound into a helix about said axis whereby the warp and woof threads of the second band each respectively extend at an angle to said plane, the direction of the helix of the second band being opposite the direction of the helix of the first band;

means at the opposite ends of said layers connecting the respective ends together; and strap means at the opposite ends of said layers for connecting the pad to a sling.

6. In a pad for use between a load and an overhead lifting sling:

first and second annular layers, the second layer being disposed inside the first layer and each formed in the shape of an oval and being co-axial about an axis, the long sides of the oval of the outer layer being adapted to engage the load or the sling;

yieldable, flexible adhesive between the layers and connecting the layers together;

said first layer comprising a first woven band having warp and woof threads and wound into a helix about said axis whereby the warp and woof threads of the band each respectively extend at an angle to a plane containing said axis;

said second layer comprising a second woven band having warp and woof threads and wound into a helix about said axis whereby the warp and woof threads of the second band each respectively extend at an angle to said plane, the direction of the helix of the second band being opposite the direction of the helix of the first band;

a generally planar third layer inside of the second layer, the third layer comprising a woven band having warp and woof threads, the warp threads of which extend generally parallel to said axis;

means at the opposite ends of said layers connecting the respective ends together; and strap means at the opposite ends of said layers for connecting the pad to a sling.

7. In a pad for use between a load and overhead lifting sling:

at least a pair of ply means disposed closely adjacent one another, one ply means to engage the load and the other ply means to engage the sling, each ply means including band means having a woven construction with warp and woof threads which interlock and function to hold one another in the band means and the respective band means being oriented so that as between adjacent band means contiguous parallel planes containing warp threads of one band means respectively angularly intersect warp threads of the other band means; and slide permitting means between said ply means and operative when the ply means are in lifting condition to permit relative sliding motion between the ply means and thereby provide for relative sliding motion between load and sling to occur without the load and sling being in contact.

8. In a pad for use between a load and an overhead lifting sling:

annular shaped outer ply means and annular shaped inner ply means disposed inside the outer ply means, the ply means being co-axial about an axis and the outer ply means to engage the load and the inner ply means to receive and engage the sling;

the outer ply means comprising first and second annular shaped layers one inside the other, yieldable, flexible adhesive means between the layers and connecting the layers together, the first layer comprising a first woven band having warp and woof threads and wound into a helix about said axis whereby the warp and woof threads of the band each respectively extend at an angle to a plane containing said axis and said second layer comprising a second woven band wound into a helix about said axis whereby the warp and woof threads of the second band each respectively extend at an angle to said plane, the direction of the helix of the second band being opposite the direction of the helix of the first band;

the inner ply means comprising third and fourth annular shaped layers one inside the other, yieldable, flexible adhesive between the layers and connecting the layers together, the third layer comprising a woven third band having warp and woof threads and wound into a helix about said axis whereby the warp and woof threads of the third band each respectively extend at an angle to said plane and said fourth layer comprises a woven fourth band having warp and woof threads and wound into a helix about said axis whereby the warp and woof threads of the fourth band each respectively extend at an angle to said plane, the direction of the helix of the fourth band being opposite the direction of the helix of the third band; and slide permitting means between said ply means and operative when the ply means are in lifting condition to permit relative sliding motion between the ply means and thereby provide for relative sliding motion between load and sling to occur without the load and sling being in contact.

9. In a pad for use between a load and an overhead lifting sling:

first ply means comprising first elongated woven band means having warp and woof threads, the warp threads running longitudinally of the band means;

second ply means comprising second elongated woven band means having warp and woof threads, the warp threads running longitudinally of the second band means, the first and second band means extending in the same direction whereby the respective warp threads are generally parallel;

slide permitting means including third ply means disposed between the first and second ply means and comprising third woven band means having warp and woof threads, the warp threads of the third band means running transverse the longitudinal axis of the third band means whereby contiguous parallel planes containing the warp threads of the third woven band means angularly intersect at an angle of substantially 90° the warp threads of the first and second woven band means, said third ply means being operative when the ply means are in lifting condition to permit relative sliding motion between the first and second ply means and thereby provide for relative sliding motion between load and sling to occur without the load and sling being in contact; and means at opposite ends of said ply means connecting the respective ends together including strap means for connecting the pad to a sling.

10. In a pad for use between a load and an overhead lifting sling:

annular shaped outer ply means and annular shaped inner ply means disposed inside of the outer ply means, the ply means being co-axial about an axis and the inner ply means to engage the load and the outer ply means to engage the sling;

the outer ply means comprising first and second annular shaped layers one inside the other, yieldable, flexible adhesive means between the layers and connecting the layers together, the first layer comprising a plurality of sections of woven bands disposed side-by-side with adjacent edges abutting and each band section having warp and woof threads, the respective warp threads of which extend at an angle to a plane containing said axis and the second layer comprising a plurality of sections of woven bands disposed side-by-side with adjacent edges abutting and each band section having warp and woof threads and the respective warp threads of which extend at an angle to said plane, the last said angle being different from the first said angle;

the inner ply means comprising third and fourth annular shaped layers, one inside the other, yieldable, flexible adhesive means between the layers and connecting the layers together, the third layer comprising a plurality of sections of woven bands disposed side-by-side with adjacent edges abutting and each band section having warp and woof threads, the respective warp threads of which extend at an angle to said plane and the fourth layer comprising a plurality of sections of woven bands disposed side-by-side with adjacent edges abutting and each band section having warp and woof threads the respective warp threads of which extend at an angle to said plane, the last two said angles being different from one another; and slide permitting means between said ply means and operative when the ply means are in lifting condition to permit relative sliding motion between the ply means and thereby provide for relative sliding motion between load and sling to occur without the load and sling being in contact.

11. The pad of claim 10 characterized by that:

the inner ply means is discontinuous at an area defined by that opposite ends of the inner ply means are closely adjacent one another;

a cover over said area;

a plurality of straps around said inner ply means whereby the inner ply means is maintained in said annular shape and the cover is maintained in position;

the outer ply means is discontinuous at an area defined by that opposite ends of the outer ply means are closely adjacent one another;

a cover over the last said area; and a plurality of straps around said outer ply means whereby the outer ply means is maintained in said annular shape and the cover is maintained in position.

12. In a pad for use between a load and an overhead lifting sling:

annular shaped outer ply means and annular shaped inner ply means, the ply means being co-axial about an axis and the inner ply means to engage the load and the outer ply means to engage the sling;

the outer ply means comprising first and second annular shaped layers one inside the other, the first layer comprising a plurality of sections of woven bands disposed side-by-side with adjacent edges abutting and each band section having warp and woof threads, the respective warp threads of which extend at an angle to a plane containing said axis and the second layer comprising a plurality of sections of woven bands disposed side-by-side with adjacent edges abutting and each band section having warp and woof threads, the respective warp threads of which extend at an angle to said plane, the last said angle being different from the first said angle;

the inner ply means comprising third and fourth annular shaped layers, one inside the other, the third layer comprising a plurality of sections of woven bands disposed side-by-side with adjacent edges abutting and each band section having warp and woof threads, the respective warp threads of which extend at an angle to said plane and the fourth layer comprising a plurality of sections of woven bands disposed side-by-side with adjacent edges abutting and each band section having warp and woof threads, the respective warp threads of which extend at an angle to said plane, the last two said angles being different from one another; and slide permitting means between said ply means and operative when the ply means are in lifting condition to permit relative sliding motion between the ply means and thereby provide for relative sliding motion between load and sling to occur without the load and sling being in contact.

13. The pad of claim 12 characterized by that:

the inner ply means is discontinuous at an area defined by that opposite ends of the inner ply means are closely adjacent one another;

a cover over said area;

a plurality of straps around said inner ply means whereby the inner ply means is maintained in said annular shape and the cover is maintained in position;

the outer ply means is discontinuous at an area defined by that opposite ends of the outer ply means are closely adjacent one another;

a cover over the last said area; and a plurality of straps around said outer ply means whereby the outer ply means is maintained in said annular shape and the cover is maintained in position.

14. The combination of a wire rope sling and a pad for use between the sling and the load, the pad comprising:

annular shaped outer ply means and annular shaped inner ply means disposed inside the outer ply means, the ply means being co-axial about an axis and the outer ply means to engage the load and the inner ply means being tightly engaged with the periphery of the sling;

the outer ply means comprising first and second annular shaped layers one inside the other, yieldable, flexible adhesive means between the layers and connecting the layers together, the first layer comprising a first woven band having warp and woof threads and wound into a helix about said axis whereby the warp and woof threads of the band each respectively extend at an angle to a plane containing said axis and said second layer comprising a second woven band having warp and woof threads and wound into a helix about said axis whereby the warp and woof threads of the second band each respectively extend at an angle to said plane, the direction of the helix of the second band being opposite the direction of the helix of the first band;

the inner ply means comprising third and fourth annular shaped layers one inside the other, yieldably, flexible adhesive between the layers and connecting the layers together, the third layer comprising a woven third band having warp and woof threads and wound into a helix about said axis whereby the warp and woof threads of the third band each respectively extend at an angle to said plane and said fourth layer comprises a woven fourth band having warp and woof threads and wound into a helix about said axis whereby the warp and woof threads of the fourth band each respectively extend at an angle to said plane, the direction of the helix of the fourth band being opposite to the direction of the helix of the third band; and slide permitting means between said ply means and operative when the ply means are in lifting condition to permit relative sliding motion between the ply means and thereby provide for relative sliding motion between load and sling to occur without the load and sling being in contact.

15. In combination:

a load having an annular shaped portion and an annular shaped protective pad mounted on said portion to engage a lifting sling and receive a compression load during the lift, the pad comprising:

a plurality of layers disposed closely adjacent one another, at least one layer to engage the sling and at least another layer to engage the load and each layer including band means having a woven construction with warp and woof threads which interlock and function to hold one another in the layer to take said compression load and the respective band means being oriented so that as between adjacent band means contiguous parallel planes containing warp threads of one band means respectively angularly intersect warp threads of the other band means, each angle of intersection being an angle other than a 90° angle.

16. In combination:

a load having an annular shaped portion and an annular shaped protective pad mounted on said portion, the pad comprising;

at least a pair of ply means disposed closely adjacent one another, one ply means engaging the annular shaped portion and the other ply means being adapted to be engaged by a sling for lifting the load, each ply means including at least a pair of closely adjacent band means each having a woven construction with warp and woof threads and the respective band means being oriented so that as between adjacent band means contiguous parallel planes containing warp threads of one band means respectively angularly intersect warp threads of the other band means, each angle of intersection being an angle other than a 90° angle; and slide permitting means between said ply means and operative when the ply means are in lifting condition to permit relative sliding motion between the ply means and thereby provide for relative sliding motion between load and sling to occur without the load and sling being in contact.

17. In combination, a sling and a pad for use between the sling and a load to be lifted, the pad comprising:

first and second annular shaped layers, the layers being co-axial about an axis and the second layer being inside the first, and the second layer being engaged with the periphery of the sling;

said first layer comprising first woven band means having warp and woof threads and wound into a helix about said axis whereby the warp and woof threads of the band means each respectively extend at an angle to a plane containing said axis;

said second layer comprising second woven band means having warp and woof threads and wound into a helix about said axis whereby the warp and woof threads of the second band means each respectively extend at an angle to said plane, the direction of the helix of the second band means being opposite the direction of the helix of the first band means; and yieldable, flexible adhesive means between said layers and connecting the layers together.

18. In combination:

a load having an annular shaped portion and an annular shaped protective pad mounted on said portion to engage a lifting sling and receive compression load during the lift, the pad comprising:

a plurality of layers disposed closely adjacent one another, at least one layer to engage the sling and at least another layer to engage the load and each layer having at least two sets of threads which interlock and function to hold one another in the layer to take said compression load, the respective layers being oriented so that as between adjacent layers contiguous parallel planes containing threads of at least one set in one layer angularly intersect threads of at least one set in the other layer, each angle of intersection being an angle other than a 90° angle.

19. In combination:

a load having an annular shaped portion and an annular shaped protective pad mounted on said portion, the pad comprising:

at least a pair of ply means disposed closely adjacent one another, one ply means engaging the annular shaped portion and the other ply means being adapted to engage a sling, each ply means including band means having a woven construction with warp and woof threads which inter-lock and function to hold one another in the band means and the respective band means being oriented so that as between adjacent band means contiguous parallel planes containing warp threads of one band means respectively angularly intersect warp threads of the other band means; and slide permitting means between said ply means and operative when the ply means are in lifting condition to permit relative sliding motion between the ply means and thereby provide for relative sliding motion between the annular portion and sling to occur without the annular portion and sling being in contact.

20. In a pad for use between a load an overhead lifting sling:

first ply means comprising first elongated woven band means having warp and woof threads, the warp threads running longitudinally of the band means;

second ply means comprising second elongated woven band means having warp and woof threads, the warp threads running longitudinally of the second band means and the first and second band means extending in the same direction whereby the respective warp threads are generally parallel;

slide permitting means including third ply means disposed between the first and second ply means and comprising third woven band means having warp and woof threads, the warp threads of the third band means running transverse to the longitudinal axis of the third band means whereby contiguous parallel planes containing the warp threads of the third woven band means angularly intersect the warp threads of the first and second woven band means, said third ply means being operative when the ply means are in lifting condition to permit relative sliding motion between the first and second ply means and thereby provide for relative sliding motion between load and sling to occur without the load and sling being in contact; and means at opposite ends of said ply means connecting the respective ends together including strap means for connecting the pad to the sling.

21. In a pad for use between a load and an overhead lifting sling wherein the pad receives a compression load during the lift:

a plurality of layers disposed closely adjacent one another, at least one layer to engage the sling and at least another layer to engage the load and each layer having at least two sets of threads which interlock and function to hold one another in the layer to take said compression load, the respective layers being oriented so that as between adjacent layers contiguous parallel planes containing threads of at least one set in one layer angularly intersect threads of at least one set in the other layer, each angle of intersection being an angle other than a 90° angle.

* * * * *